US007778583B2

(12) United States Patent
Katayama

(10) Patent No.: US 7,778,583 B2
(45) Date of Patent: Aug. 17, 2010

(54) ENDLESS BELT CONVEYING APPARATUS AND TONER IMAGE HEATING APPARATUS

(75) Inventor: Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 429 days.

(21) Appl. No.: 11/950,933

(22) Filed: Dec. 5, 2007

(65) Prior Publication Data

US 2008/0138125 A1 Jun. 12, 2008

(30) Foreign Application Priority Data

Dec. 12, 2006 (JP) ..... 2006-334125

(51) Int. Cl.
*G03G 15/20* (2006.01)

(52) U.S. Cl. ..... 399/329; 399/122; 219/216

(58) Field of Classification Search ..... 399/122, 399/329; 219/216
See application file for complete search history.

(56) References Cited

U.S. PATENT DOCUMENTS

| | | | | |
|---|---|---|---|---|
| 4,008,750 | A * | 2/1977 | Sivilotti | 164/481 |
| 5,027,160 | A | 6/1991 | Okada et al. | |
| 5,305,066 | A * | 4/1994 | Koh et al. | 399/338 |
| 5,964,339 | A * | 10/1999 | Matsuura et al. | 198/810.03 |
| 2002/0107123 | A1 * | 8/2002 | De Vroome | 492/10 |
| 2007/0059061 | A1 | 3/2007 | Katayama et al. | 399/329 |
| 2007/0059062 | A1 | 3/2007 | Endo et al. | 399/329 |
| 2007/0059064 | A1 | 3/2007 | Okuda et al. | 399/329 |
| 2008/0038008 | A1 | 2/2008 | Fujita et al. | 399/92 |

FOREIGN PATENT DOCUMENTS

| | | | |
|---|---|---|---|
| JP | 2-157880 | | 6/1990 |
| JP | 04360181 | A * | 12/1992 |
| JP | 09263342 | A * | 10/1997 |
| JP | 2006189632 | A * | 7/2006 |

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

The present invention related to an endless belt conveying apparatus and toner image heating apparatus having spring members (thermally responsive members) composed of a shape memory alloy are disposed to both the edges of a pressure fixing belt (pressure belt) in the belt width direction thereof. When the pressure fixing belt offsets to one side in the belt width direction while it travels, one of the spring members, which is heated by the edge of the pressure belt approaching it, is deformed in response to the heat. A roller swing support frame on the belt edge side, which approaches the above spring member, is lifted upward in a gravity direction using a swing pin as a fulcrum in a gravity direction by the operation force generated by the deformation of the one spring member. The swing operation is alternately repeated between the one spring member and the other spring member to thereby correct the inclination of the pressure belt.

10 Claims, 22 Drawing Sheets

ENDLESS BELT CONVEYING APPARATUS AND TONER IMAGE HEATING APPARATUS

BACKGROUND OF THE INVENTION

1. Field of the Invention

The present invention relates to an endless belt conveying apparatus having an endless belt and to a toner image heating apparatus having the endless belt conveying apparatus. The endless belt conveying apparatus and the toner image heating apparatus are used to an image forming device of an electrophotographic copy machine, facsimile, and printer or to a composite machine and the like having a plurality of functions of them.

2. Description of the Related Art

There are known fixing apparatuses of a system for permanently fixing an unfixed toner image by pressing and heating it by causing a recording material, which bears the unfixed toner image on the upper surface thereof, to come into intimate contact with an endless-belt-like fixing film and to pass the unfixed toner image together with the fixing film through a fixing nip portion between a pressure rollers and the fixing film. The endless-belt-like fixing film is trained around a drive roller and a driven roller and travels in rotation, and when the fixing film moves while offsetting to one side in a width (belt width) direction during the travel, it continuously offsets until it comes into contact with other member.

A structure as shown in FIG. 19 is ordinarily known to as a structure for preventing offset. In this case, flanges 112 are standingly disposed on both the ends of a roller in the width direction thereof, and when a belt 104 is offset, an edge thereof is caused to come into contact with the flange 112 so that the belt 104 is prevented from being further offset. However, the ordinary structure is disadvantageous in that the edges of the belt 104 and the flanges 112 on the roller side are in sliding contact with each other and worn.

Incidentally, as shown in FIG. 20, it is considered that the belt is offset mainly by that the rotational axis lines of both the drive roller 102 and the driven roller 103 are not in parallel with each other and thus relatively inclined. Accordingly, the offset of the belt can be suppressed by correcting the inclination of the rollers. The applicant previously proposed a fixing apparatus provided with a structure for preventing an offset of a belt (refer to, for example, Japanese Patent Application Laid-Open No. 2-157880). The structure will be briefly described referring to FIG. 20.

Offset detection sensors 113*a*, 113*b* are disposed on both the edge sides of a belt 104 in the width direction thereof, and the offset of the belt is suppressed by correcting the inclination of the rotational axis line of the driven roller 103 by an adjustment mechanism. That is, when the belt 104 is offset in the direction of an arrow B in the belt width direction while it travels in rotation in the direction of an arrow A, the offset detection sensor 113*b* detects the offset. The rotational axis line of the driven roller 103 is lowered on the proximal side thereof in FIG. 21 which is opposite to the direction of the arrow B by operating the adjustment mechanism in the direction of an arrow C based on a result of detection. When the inclination of the rotational axis line of the roller, that is, a "roller axial angle" is corrected as described above, the belt 104 moves back in the direction of an arrow D, thereby the belt 104 can be corrected to a normal attitude. When the belt is offset in a direction opposite to the direction of the arrow B, the offset detection sensor 113*a* detects the offset and lifts up the driven roller 103 on the proximal side thereof in the direction of an arrow E as shown in FIG. 22, With this operation, the belt 104 moves back in an F direction and is corrected to the normal attitude.

While the belt travels in rotation, the inclined roller rotational axis line, that is, a roller axial angle is alternately corrected repeatedly. That is, when the belt 104 is offset to one side in the belt width direction, the one side is lifted up, whereas when it is offset to the other side, the other side is lifted up, thereby the belt 104 is caused to continuously travel in rotation while alternately repeating the correction.

However, components and equipments such as a motor acting as a power source, a speed reduction gear train, an offset detection sensor, and the like for adjusting the roller axial angle of the driven roller 103 are necessary in the offset prevention mechanism disclosed in Japanese Patent Application Laid-Open No. 2-157880. Accordingly, there is a possibility that the size and cost thereof are increased and thus there is a room for improving the offset prevention mechanism.

SUMMARY OF THE INVENTION

Accordingly, the present invention provides an endless belt conveying apparatus and a toner image heating apparatus capable of preventing an increase in size of a mechanism for moving an endless belt in the width direction thereof.

The present invention also provides an endless belt conveying apparatus and a toner image heating apparatus capable of preventing an increase of cost of a mechanism for moving an endless belt in the width direction thereof.

Other objects of the present invention will become apparent by reading the following detailed description with reference to the accompanying drawings.

An endless belt conveying apparatus includes an endless belt, a supporting member which rotatably supports the belt, a driving mechanism which causes the belt to rotate, a heating member which heats the belt, and a displacing device which displaces one end of the supporting member in the longitudinal direction thereof to move the belt in the width direction thereof, wherein the displacing device comprises a thermally responsive member which can be thermally deformed as it approaches the belt, which is heated by the heating member, in the width direction thereof to change a moving direction of the belt in the width direction.

A toner image heating apparatus includes an endless belt which heats a toner image on a recording material at nip portion, a supporting member which rotatably supports the belt, a driving mechanism which causes the belt to rotate, a heating member which heats the belt, and a displacing device which displaces one end of the supporting member in the longitudinal direction thereof to move the belt in the width direction thereof, wherein the displacing device comprises a thermally responsive member which can be thermally deformed as it approaches the belt, which is heated by the heating member, in the width direction thereof to change a moving direction of the belt in the width direction.

Further features of the present invention will become apparent from the following description of exemplary embodiments (with reference to the attached drawings).

DESCRIPTION OF THE EMBODIMENTS

Figure 1:
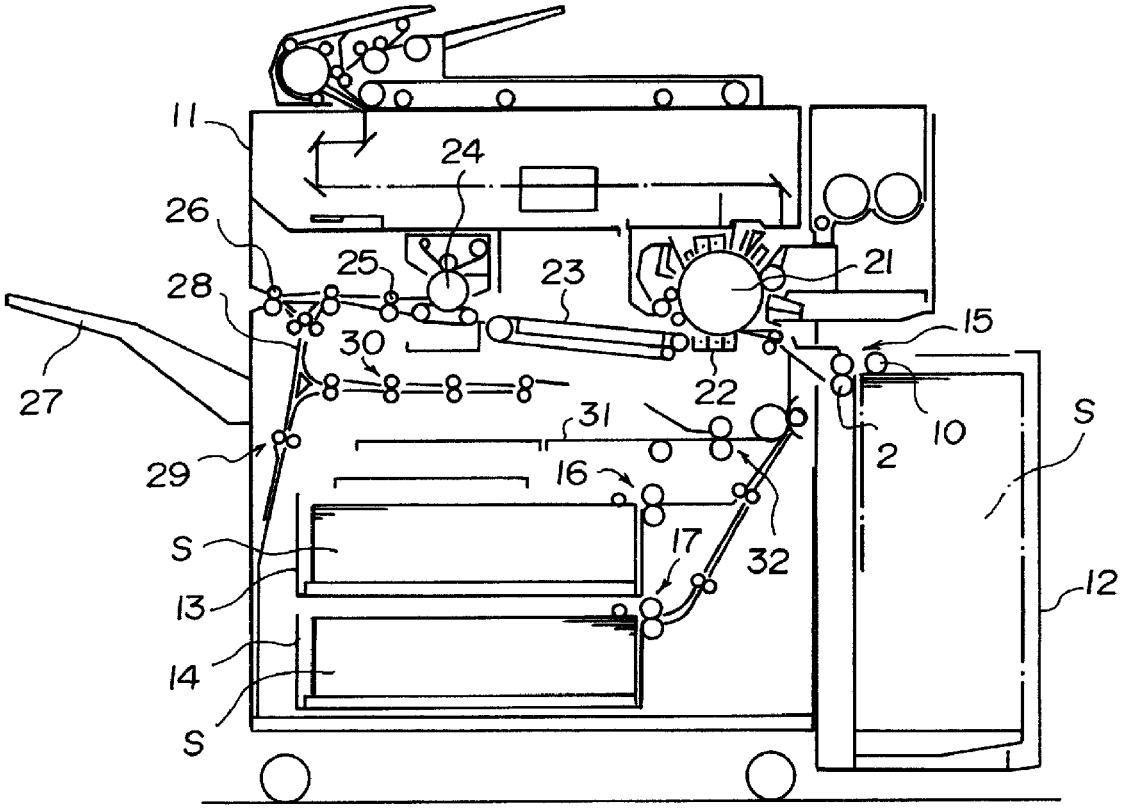
FIG. 1 is a schematic sectional view illustrating an image forming device.

The respective preferable embodiments of an endless belt conveying apparatus and a toner image heating apparatus according to the present invention will be described below in detail referring to the drawings. First, an image forming unit of an image forming device will be described and then the endless belt conveying apparatus and a fixing apparatus as the toner image heating apparatus will be described.

Embodiment 1

(Image Forming Device)

FIG. 1 is a schematic view of the image forming device. A main body 11 of the image forming device has a feed deck 12 which is disposed on one side thereof and in which a lot of recording materials S are stacked and accommodated. Further, the main body 11 has a plurality of sheet feed cassettes 13, 14, which are disposed to the lower inside portion thereof and in which the recording materials S are stacked and accommodated. Further, retard separation type sheet feeders 15, 16, 17 are disposed to the portions where the feed deck 12 and the feed cassettes 13, 14 are installed. When a recording material S is fed by the respective sheet feeders 15, 16, 17, it is fed to a resist roller pair 18 whose rotation is stopped, and the skew feeding attitude of the recording material S is corrected.

The recording material S is fed between a photosensitive drum 21, which acts as an image bearing member constituting the image forming unit, and a transfer charger 22 by a registration roller pair 18 which rotates at timing at which a latent image is formed on the recording material S. Here, a toner image formed on the photosensitive drum 21 is transferred onto the recording material S. Thereafter, the recording material S is fed to an image heating apparatus 24 by a conveying belt 23, and the unfixed toner image transferred thereonto is pressed against and fixed to the recording material S and permanently fixed.

The main body 11 can be provided with a both-surface copy mode for carrying out a copy to both the front and rear surfaces of a recording material S and a multiple copy mode for carrying out a multiple copy thereonto. In an ordinary copy mode (single-surface copy mode), a recording material S subjected to fix processing is discharged onto a discharge tray 27 outside of the machine by an inside discharge roller pair 26. Further, in the both-surface copy mode and the multiple copy mode, a recording material S is temporarily stacked and accommodated on an intermediate tray 31 by an inside discharge roller pair 25 or a switch back roller pair 29 through a refeed path 28 and a both-surface conveying path 30 . The recording material S accommodated on the intermediate tray 31 is conveyed again to the resist roller pair 18 by a refeed unit 32 to form an image again, and then discharged to the outside of the machine by the same process as the single-surface copy.

(Fixing Device)

Figure 2:
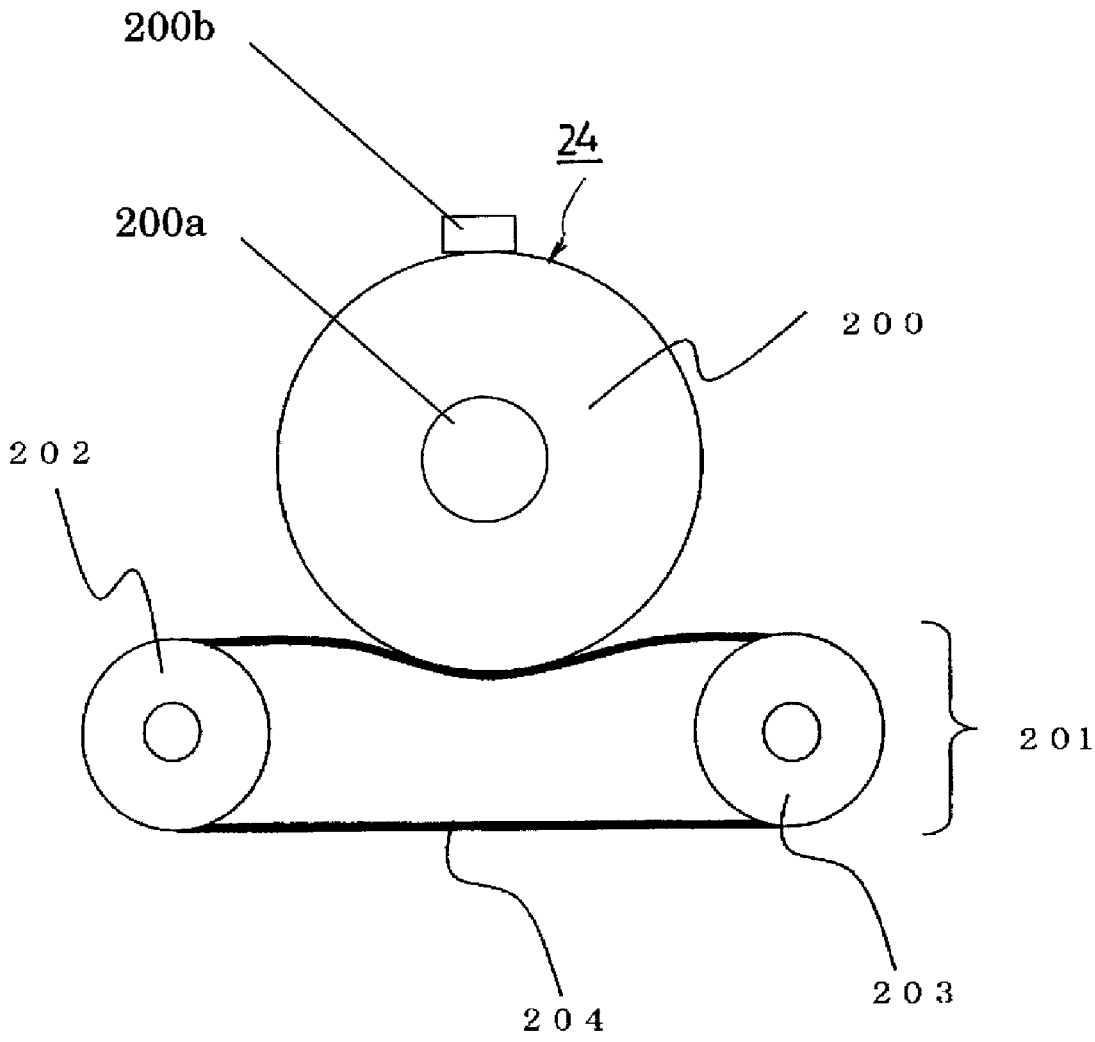
FIG. 2 is a view illustrating a pressure unit in a fixing apparatus.

FIG. 2 is a schematic view of the fixing apparatus 24 as the toner image heating apparatus. The fixing apparatus 24 includes a fixing roller 200 and a pressure unit 201. A halogen heater 200*a* as a heating member is built in the fixing roller 200. Then, a temperature is detected by a thermistor 200*b* in contact with the surface of the fixing roller, and power supplied to the halogen heater is controlled according to the detected temperature. The pressure unit 201 as the endless belt conveying apparatus has a pressure belt 204 as an endless belt. The pressure belt 204 has a function for forming a fixing nip for fixing the unfixed toner image on the recording material by heating and pressing the toner image between the pressure belt 204 and the fixing roller 200. The pressure belt is stretched between a drive roller 202 as a driving member, to which rotational driving force is transmitted from a motor as a rotation drive source, and a driven roller 203 as a supporting member. The distance between the axes of the drive roller 202 and the driven roller 203 is adjusted by applying a force in a direction where the driven roller 203 is separated from the drive roller 202 by a tension application means (not shown). With this operation, the pressure belt 204 can be driven in rotation with an appropriate amount of tension applied thereto. That is, the driven roller 203 acts as a tension roller.

(Belt Offset Prevention Mechanism)

Figure 3:
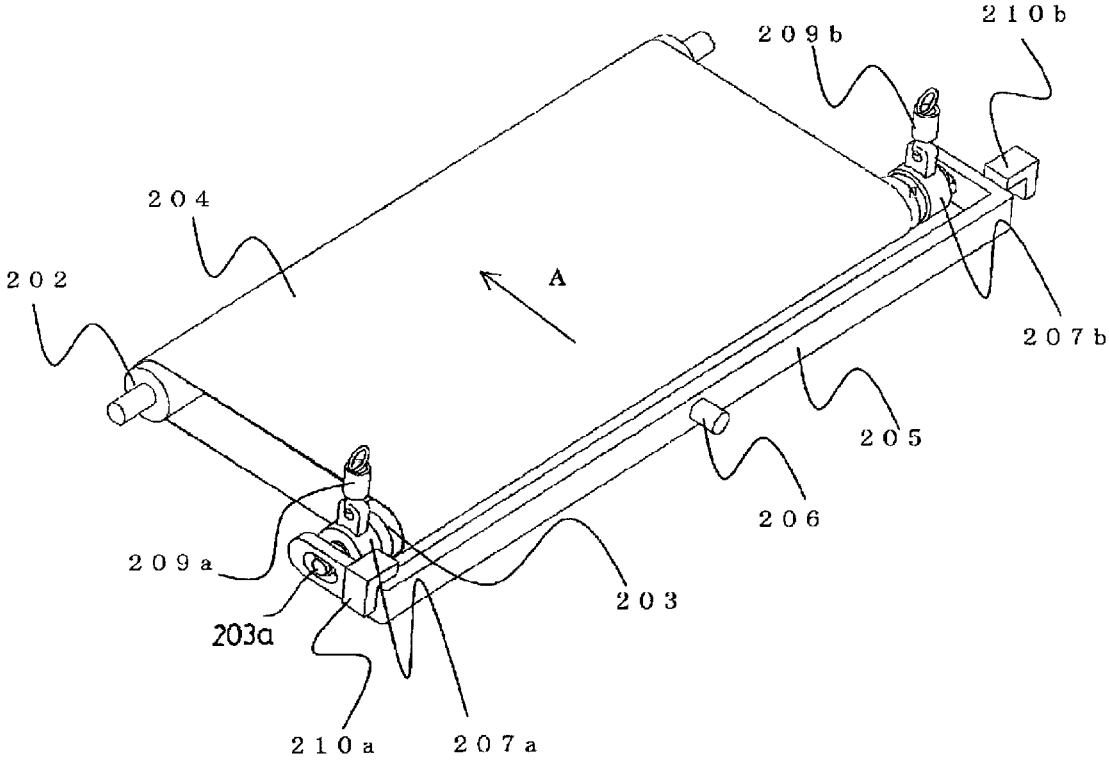
FIG. 3 is a perspective view illustrating the main portions of a belt offset prevention mechanism and a swing frame.

FIG. 3 is a schematic view of a belt offset prevention mechanism as a displacing mechanism. Note that the rotational axis line direction of the driven roller 203 is also called a longitudinal direction. Further, the rotational axis line direction (longitudinal direction) is a direction in parallel with the width direction of the pressure belt. As shown in FIG. 3, the belt offset prevention mechanism has a long swing frame 205 for rotatably supporting the driven roller 203 at both the shaft ends 203*a*, 203*b* thereof along the rotational axis line.

The long swing frame 205 is formed in a C-shape with both the ends thereof bent at a right angle, and the driven roller 203 is rotatably journaled by engaging both the shaft ends 203*a*, 203*b* thereof with bearing holes defined to the C-shape portions at both the ends of the swing frame 205. Then, the swing frame 205 is supported by a unit frame of the pressure unit in an intermediate portion thereof in the longitudinal direction through a swing pin 206 so that it can be swung as if it is a "seesaw". Accordingly, when an end of the swing frame 205 is displaced upward in a gravity direction, any one of both the shaft ends 203*a*, 203*b* of the driven roller 203 is displaced together with the swing frame 205, thereby the rotational axis line of the driven roller is inclined.

Heat transmission members 207*a*, 207*b* are swingably supported on the shaft of both the shaft ends 203*a*, 203*b* of the driven roller 203, respectively. Note that since the offset prevention mechanism is arranged similarly on one end side and the other end side in the rotational axis line of the driven roller 203, the offset prevention mechanism will be described using FIG. 4 as to the shaft end 203*a* side as one end side in the rotational axis line direction of the driven roller 203, and the detailed description of the other end side thereof is omitted.

Each of the heat transmission members 207*a*, 207*b* is provided with a cylindrical portion 207*c* (FIG. 7) having approximately the same diameter as that of the driven roller 203. Further, aluminum for example, which has a high heat conductivity is used as the material of the heat transmission members 207*a*, 207*b*. Heat insulation bushes 208 are interposed between the driven roller 203 and the heat transmission members 207*a*, 207*b* so that heat is unlike to transmit at once from the driven roller 203 to the heat transmission members 207*a*, 207*b*. A material having a low heat conductivity and a high heat resistance is preferably selected as the material of the heat insulation bushes 208. Further, even if the driven roller 203 is rotated, the heat insulation bushes 208 are not rotated and fixed, thereby the outer peripheries of both the shaft ends 203*a*, 203*b* of the driven roller 203 are in sliding contact with the inner peripheries of the heat insulation bushes 208. Accordingly, a material excellent in a sliding contact property is preferably used as the material of the heat insulation bushes 208, and a resin material such as PPS is used in the example.

Figure 4:
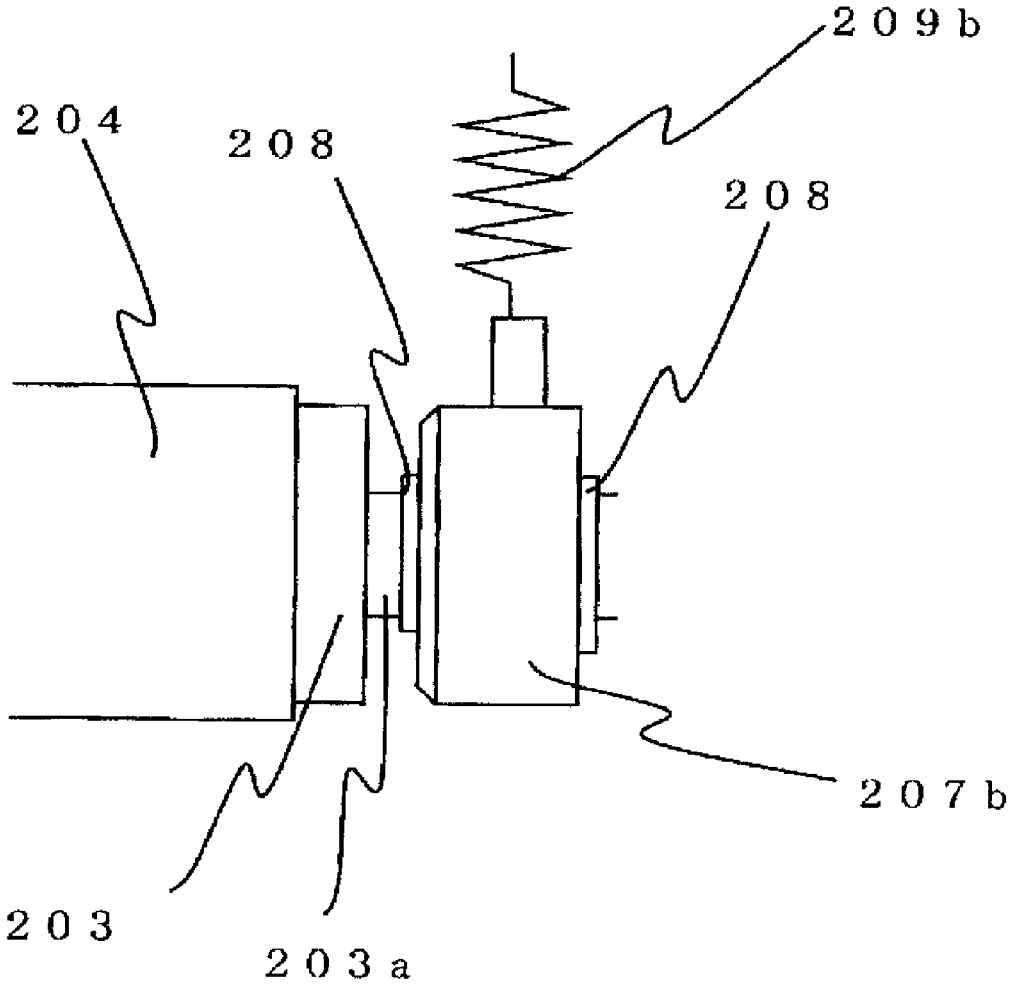
FIG. 4 is a view illustrating a thermally responsive member and its relating mechanism on one edge side of the swing frame.
Figure 5:
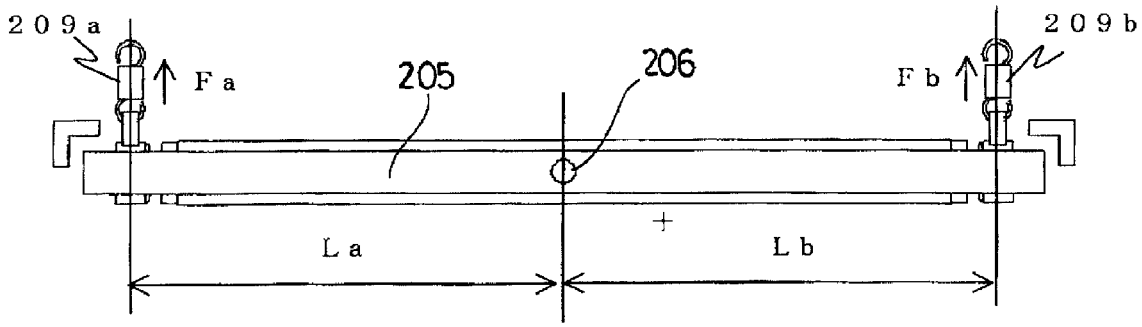
FIG. 5 is a view illustrating a moment equilibrium state from the fulcrum of swing of the swing frame.

As shown in FIG. 3 to FIG. 5, one ends of shape memory alloy spring members (urging members) 209*a*, 209*b* as thermally responsive members are coupled with the upper portions of the heat transmission members 207*a*, 207*b*. A material called an artificial muscle is used as the material of the spring members.

That is, the spring members 209*a*, 209*b* press and urge the rotational axis line of the driven roller 203 to a steady horizontal position. It is preferable to set the shape restoring temperature of the spring members 209*a*, 209*b* within the range of, for example, 50 to 250° in correspondence to the fixing temperature in the fixing apparatus 24, and the temperature is set to 150° in the example. The shape restoring temperature can be detected by detecting the temperature of the spring members 209*a*, 209*b* themselves transmitted from a peripheral member (refer to an arrow in FIG. 8). When the temperature exceeds 150°, the shape of the spring members 209*a*, 209*b* is restored to a shrunk shape, thereby any one of both the shaft ends 203*a*, 203*b* of the driven roller is lifted upward in the gravity direction by the operating force generated by the shrinking deformation. Further, the spring members 209*a*, 209*b* are formed of an alloy of Ni (nickel) and Ti (titanium), and the shape restoring temperature can be set to a high temperature by reducing a Ni content and containing Co (cobalt) and the like. Ordinarily, since the atmospheric temperature in the vicinity of the spring members 209*a*, 209*b* is about 100°, the shape of the spring members 209*a*, 209*b* is not restored in the state in which the pressure belt 204 is not offset. In contrast, when the one spring member 209*b* is heated to a shape restoring temperature, the shape of the spring member 209*b* is restored and the spring member 209*b* is shrunk to a previously set shape. At the time, the forces of Fa and Fb are unbalanced (refer to FIG. 5), thereby the swing frame 205 is made to a state shown by FIG. 9 by being swung counterclockwise and comes into contact with a stopper 210*b*.

Further, the distance La from the one spring member 209*a* to the swing fulcrum 206 of the swing frame 205 and the distance Lb from the swing fulcrum 206 to the other spring member 209*b* are set to the same distance. Further, in the state shown in FIG. 5, the force, by which the one spring member 209*a* lifts the driven roller 203 upward through the swing frame 205, is shown by Fa, and the force, by which the other spring member 209*b* lifts the driven roller 203 upward is shown by Fb. When Fa=Fb is set, the relation between the forces Fa, Fb and the moments acting on the swing frame 205 in that case is expressed by the following equation.

$$Fa \times La = Fb \times Lb \quad (1)$$

From the equation, the moments are balanced through the swing fulcrum 206.

Figure 6:
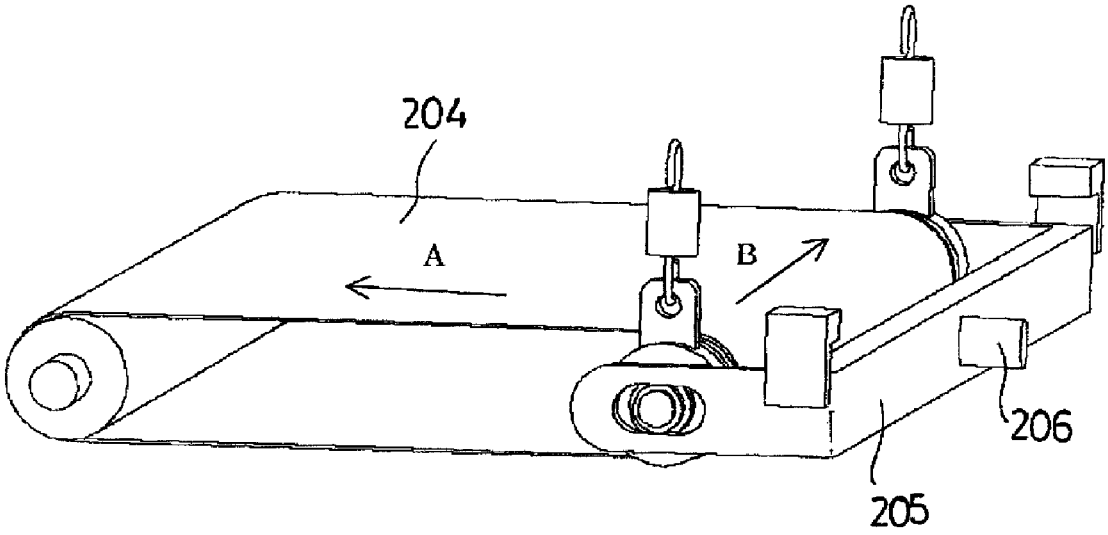
FIG. 6 is a perspective view illustrating an example a belt traveling in an offset state.

Thus, it is assumed as shown in FIG. 6 that the pressure belt 204, which is heated by the halogen heater 200*a* built in the fixing roller 200, is offset in the direction of an arrow B which is one edge side of the belt in the width direction thereof while the belt travels in rotation in the direction of an arrow A.

Figure 7:
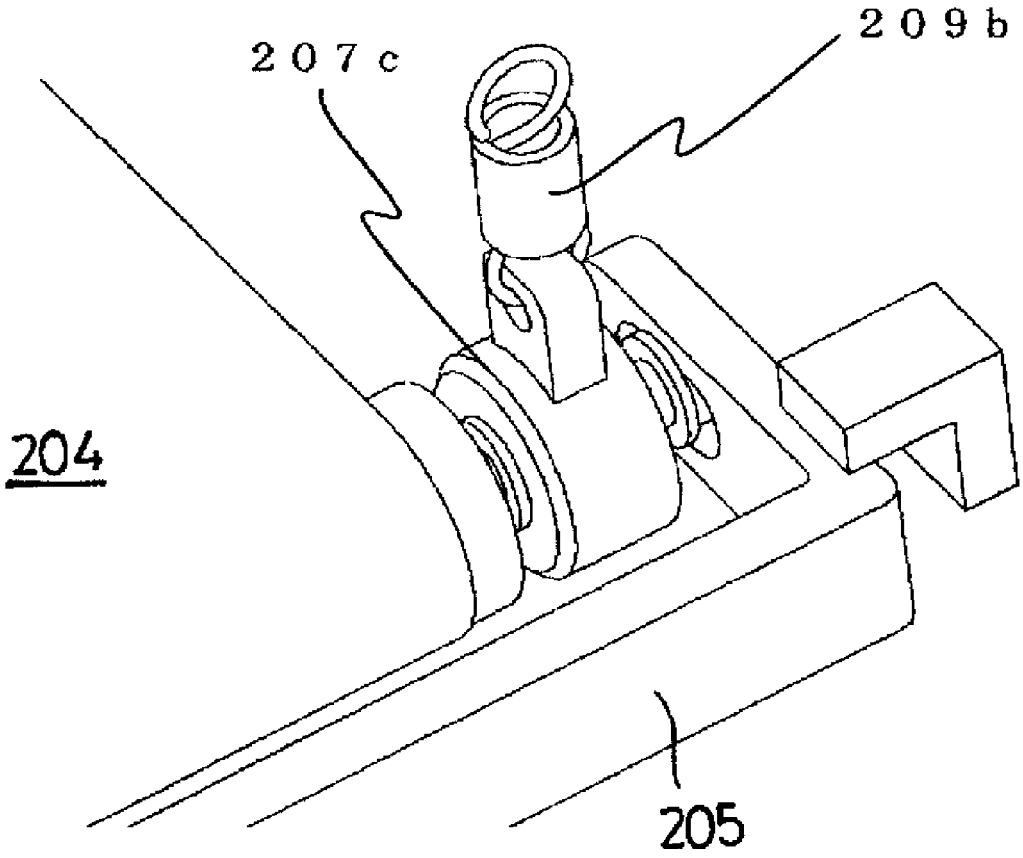
FIG. 7 is a perspective view illustrating only one edge side of a belt when it travels in the offset state.
Figure 8:
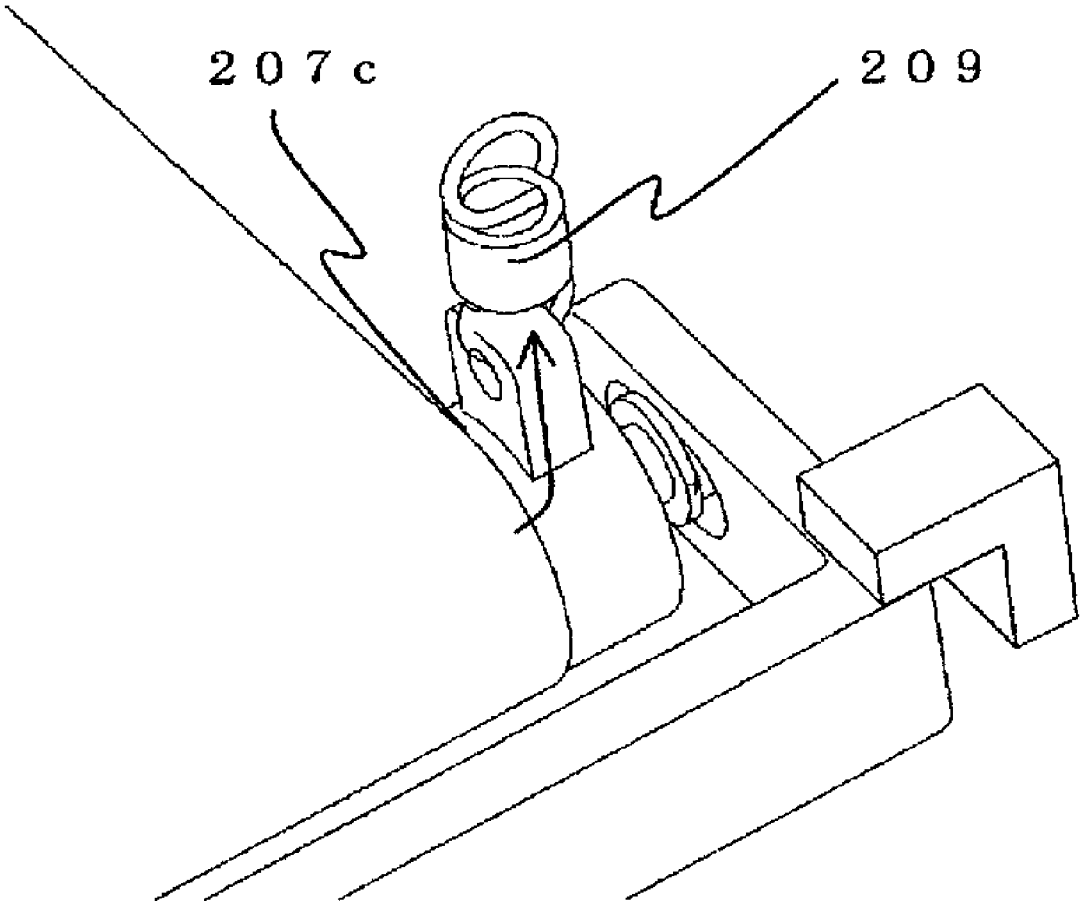
FIG. 8 is a view illustrating a mode in which heat is transmitted from the belt.

Since the heat transmission member 207*b* is provided with the cylindrical portion 207*c*, the inside surface of the edge of the pressure belt 204 comes into contact with the outer periphery of the cylindrical portion 207*c* and heat is transmitted from the pressure belt 204 to the cylindrical portion 207*c* (refer to FIGS. 7, 8). Although a structure for receiving heat on the inside surface of the edges of the pressure belt 204, is shown, a structure for receiving heat by the outer periphery or the edges of the belt is also possible. When the temperature of the fixing roller 200 is adjusted to 200°, since the edges of the pressure belt 204 do not come into contact with the recording material S, the temperature of the edges of the pressure belt transmitted from the fixing roller 200 at the fixing nip portion does not become lower than 150° even if it is lowered. Accordingly, when the pressure belt 204 is offset and comes into contact with the heat transmission member 207*b* while it travels in rotation, the spring member 209*b* receives the heat of the pressure belt 204 from the heat transmission member 207*b* and heated to a temperature of 150° or more.

At the time, when the force, by which the spring member 209*a* lifts the driven roller 203 upward is shown by Fa', and the force, by which the other spring member 209*b* lifts the driven roller 203 upward, is shown by Fb', the following relation is established.

$$Fa' \times La < Fb' \times Lb \quad (2)$$

When the relation of the above equation (2) is satisfied, the driven roller 203 can be located at a predetermined position even if the moments of the spring members 209*a*, 209*b* acting on the driven roller 203 are not balanced. When the stopper 210*b* is not provided, the driven roller 203 is stopped at the position at which the moments of the spring members 209*a*, 209*b* are balanced.

Figure 9:
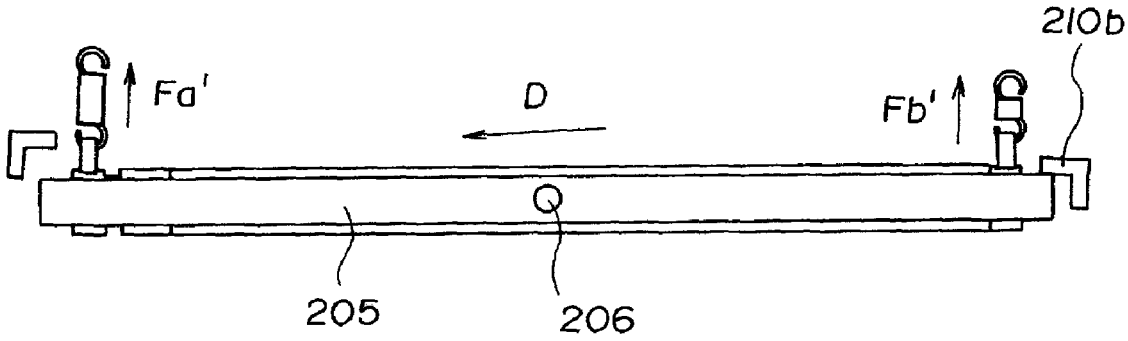
FIG. 9 is a view illustrating a mode in which the belt travels in the offset state.
Figure 10:
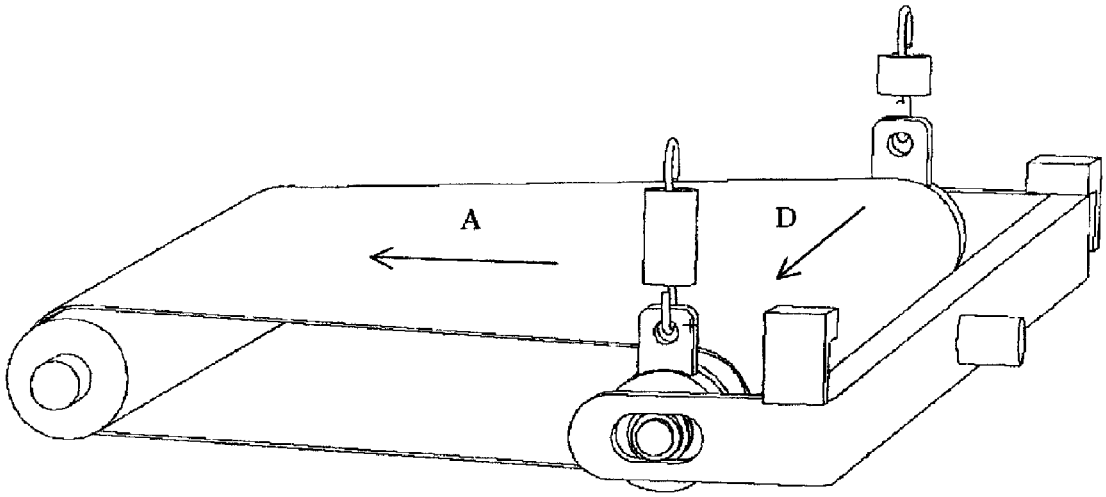
FIG. 10 is a perspective view illustrating a mode corresponding to FIG. 9.
Figure 11:
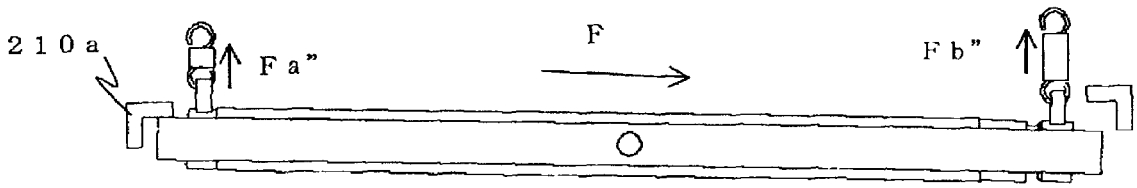
FIG. 11 is a view illustrating a mode when the belt travels in the offset state in a direction opposite to FIG. 9.

When the state shown in FIG. 9, in which an edge of the driven roller 203 is lifted upward and stopped by coming into contact with the stopper 210*b*, is achieved, the pressure belt 204 begins to offset in the direction of an arrow D shown in FIG. 10. When the pressure belt 204 continues to offset and comes into contact with the heat transmission means 207*a*, thereby the spring member 209*a* is heated and restores its shape. With this operation, the swing frame 205 is swung clockwise using the swing pin 206 as a fulcrum, comes into contact with the stopper 210*a*, and is placed in the state shown in FIG. 11.

At the time, when the force, by which the one spring member 209*a* lifts the driven roller upward, is shown by Fa" and, the force, by which the other spring member 209*b* lifts the driven roller 203 upward is shown by Fb", the following equation is established.

$$Fa''\times La>Fb''\times Lb \quad (3)$$

Figure 12:
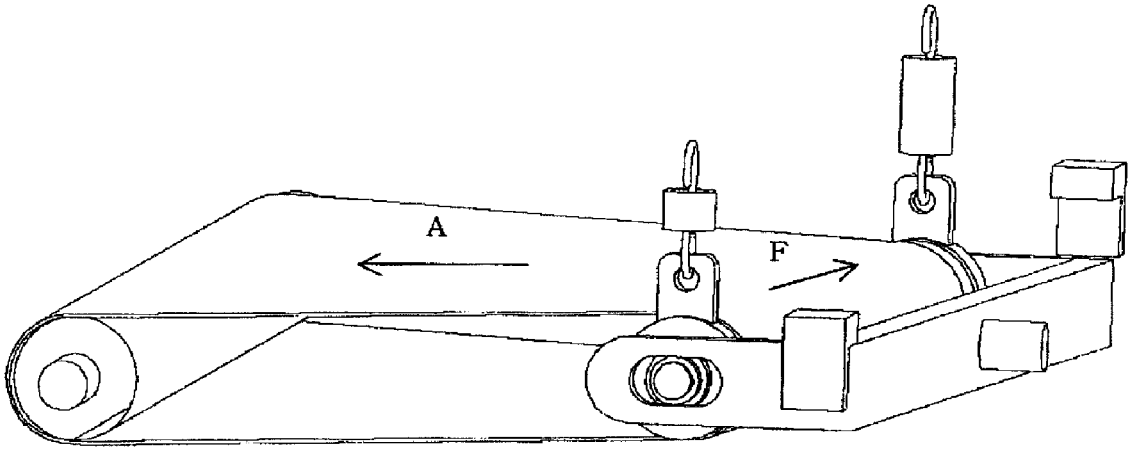
FIG. 12 is a perspective view illustrating a mode corresponding to FIG. 11.

As a result, the pressure belt 204 begins to offset in a direction F shown in FIG. 12.

What has been described above is summarized, the driven roller 203 supported by the swing frame 205 repeatedly swings right and left alternately using the swing pin 206 as the fulcrum as if it was a seesaw. As a result, the pressure belt 204, which travels in rotation, does not offset in the width direction in excess of a prescribed amount and thus swings in a normal center zone at the center in the width direction. That is, the pressure belt can be maintained in the normal zone.

As described above, in this embodiment, since thermally responsive members, which are deformed in response to the heat of the pressure belt, are used, the offset motion of the pressure belt can be automatically corrected while it travels in rotation.

Accordingly, the offset motion of the pressure belt can be automatically corrected without using the conventional components and mechanisms such as a motor, transmission gear train, offset detection sensor, and the like. That is, the offset motion of the pressure belt can be automatically corrected without increasing the size and cost of the device.

Embodiment 2

Next, an embodiment 2 will be described. Note that since the embodiment 2 has the same arrangement as that of the embodiment 1 except the modified points described below, the description of the arrangement of the embodiment 2 is omitted.

Figure 13:
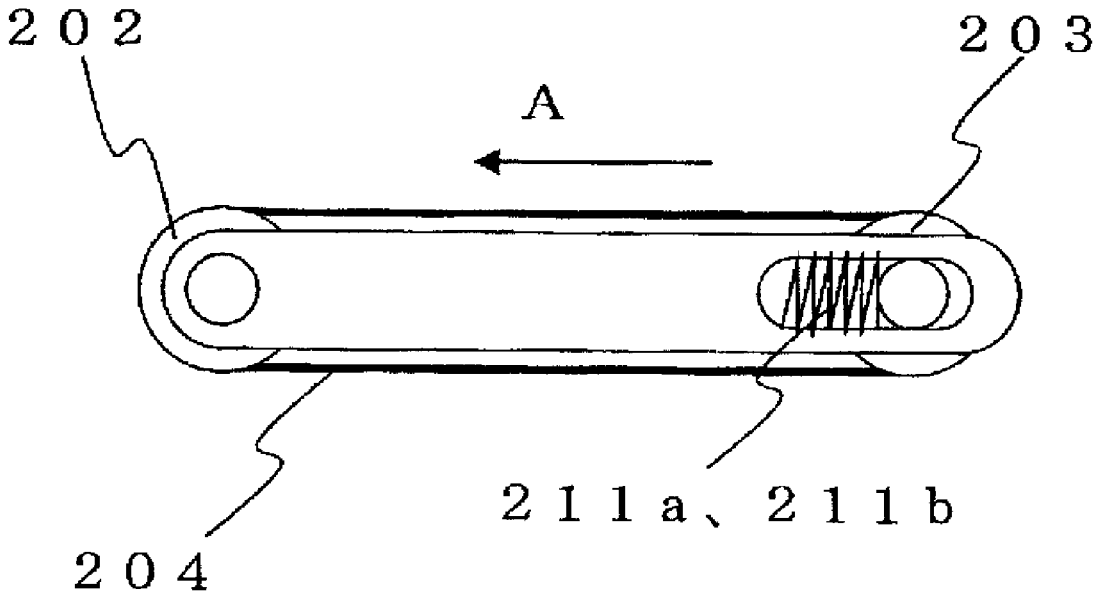
FIG. 13 is a view illustrating a pressure unit of an embodiment 2.
Figure 14:
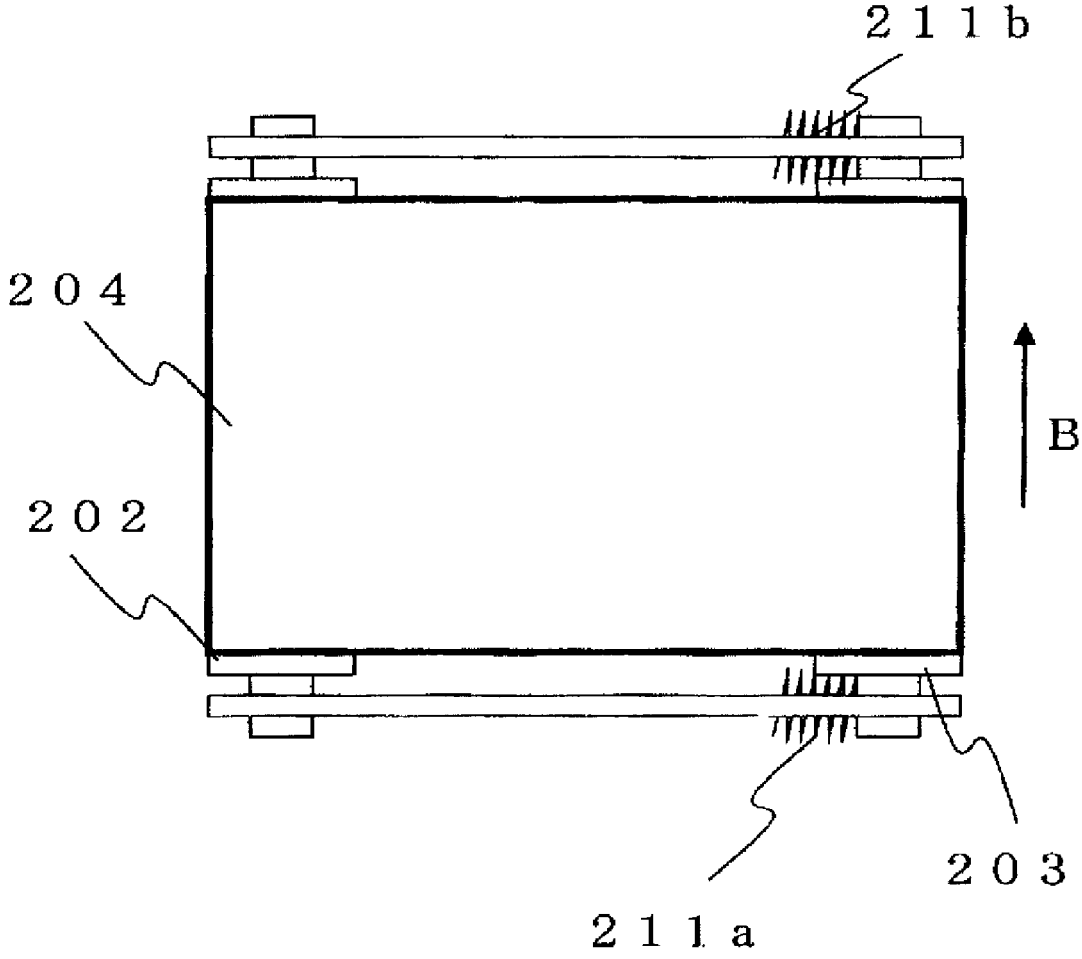
FIG. 14 is a view illustrating the pressure unit of the embodiment 2.

As shown in FIGS. 13 and 14, a pressure unit as an endless belt conveying apparatus has the following structure. That is, the pressure unit includes coil-shaped spring members 211*a*, 211*b* for urging a driven roller 203 in a direction where it is separated from a drive roller 202, and a pressure belt 204 is caused to travel in rotation while being applied with appropriate tensions in the belt width direction thereof. The spring members 211*a*, 211*b* urge both the ends of the driven roller 203, respectively.

That is, when tensions, which are applied to both the edges of the pressure belt 204 in the belt width direction thereof in a balanced state, change the balance of the forces of the spring members 211*a*, 211*b*, the offset of the pressure belt 204 can be automatically corrected. The spring members 211*a*, 211*b* are composed of a shape memory alloy having a shape restoring temperature of to 150° likewise and store the shapes thereof such that they are extended at the shape restoring temperature. Further, the embodiment 2 is provided with heat transmission members likewise the embodiment 1. When, for example, the pressure belt 204 is offset in a B direction, since the spring member 211*b* intends to extend by restoring its shape, the force generated by it is increased. With this operation, the offset motion of the pressure belt 204 is returned in a direction opposite to the B direction, thereby the offset of the pressure belt 204 begins to be corrected. It is possible to cause the pressure belt 204 to travel in rotation in a stable attitude without offset by repeating the operation.

Modified Embodiment

Although the embodiments 1, 2 of the endless belt conveying apparatus and the toner image heating apparatus of the present invention are described above, the present invention is by no means limited thereto unless it does not depart from the gist of the present invention.

Specifically, although the endless belt conveying apparatus is described using the pressure unit of the fixing apparatus as the example, the application of the present invention is not limited to the belt for the fixing apparatus. That is, the present invention can be also applied likewise to endless belt conveying apparatuses, which are in an environment in which they are heated, for example, a transfer belt device in an image forming unit, a recording material conveying device for conveying recording materials, and the like.

Further, although the fixing apparatus is described as the example of the toner image heating apparatus in the embodiments 1, 2, the present invention can be also applied likewise to a "glossiness increasing device" for increasing the degree of glossiness of an image by heating a toner image fixed onto a recording material.

Further, although the structure example, in which the spring members 209*a*, 209*b* as the thermally responsive members each composed of the shape memory alloy are mounted on both the ends of the driven roller 203, is shown above, the present invention is by no means limited only thereto. For example, any one of the spring members may not be composed of the shape memory alloy and may be composed of an ordinary spring steel.

Figure 15A:
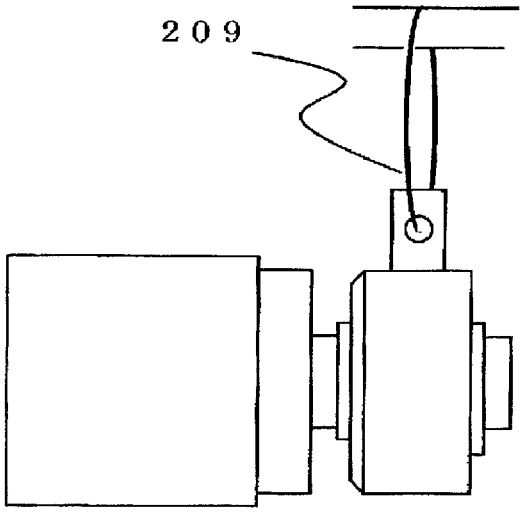
FIG. 15 is a view illustrating a main portion of a pressure unit of a modified embodiment.
Figure 15B:
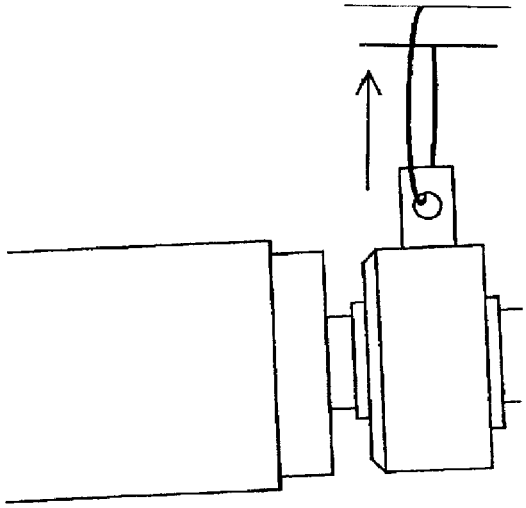
Figure 16A:
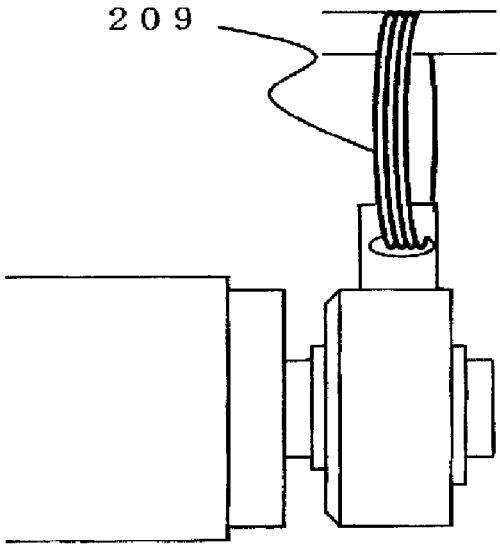
FIG. 16 is a view illustrating a main portion of the pressure unit of the modified embodiment.
Figure 16B:
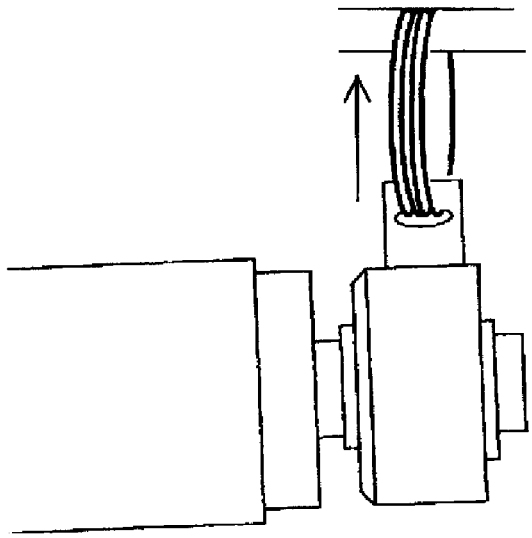
Figure 17A:
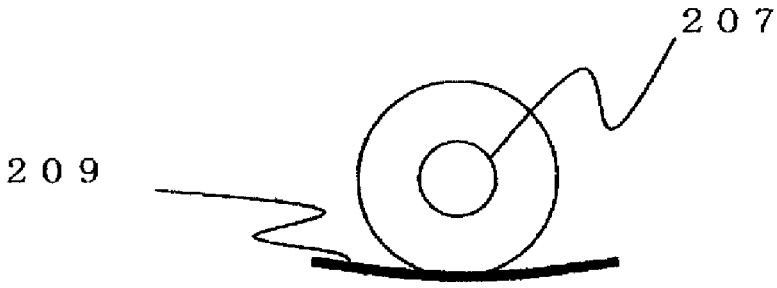
FIG. 17 is a view illustrating a main portion of the pressure unit of the modified embodiment.
Figure 17B:
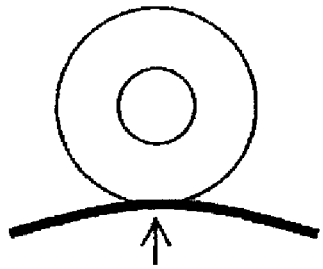
Figures 18A, 18B:
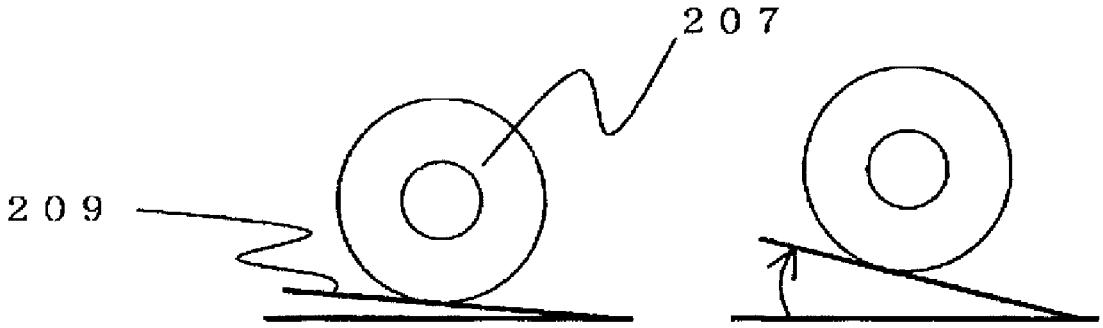
FIG. 18 is a view illustrating a main portion of the pressure unit of the modified embodiment.
Figure 19:
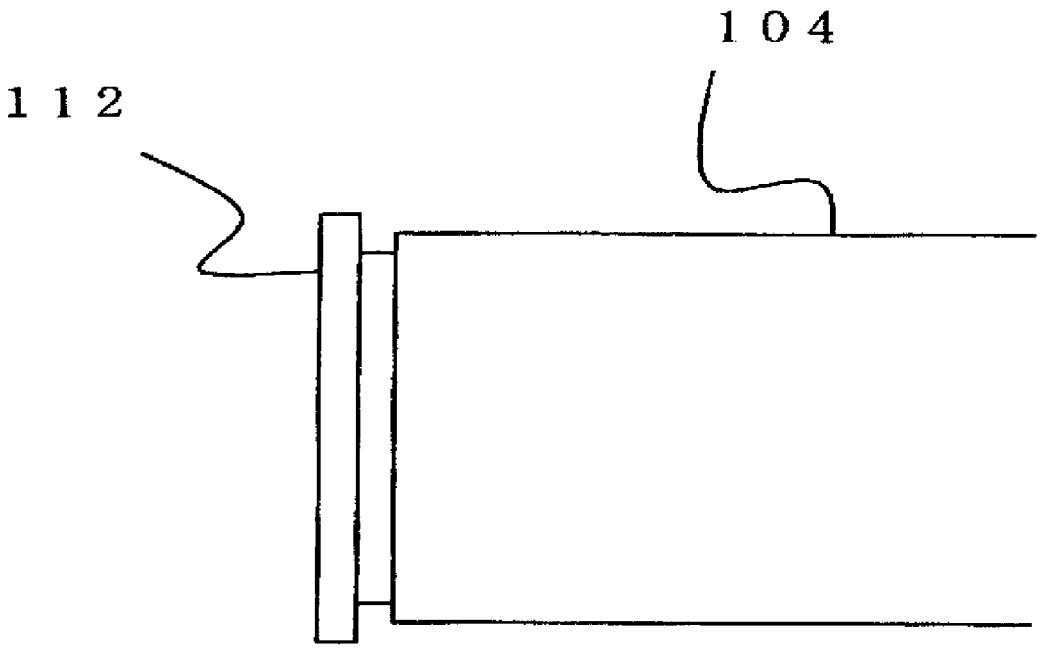
FIG. 19 is a view illustrating the structure of a conventional example.
Figure 20:
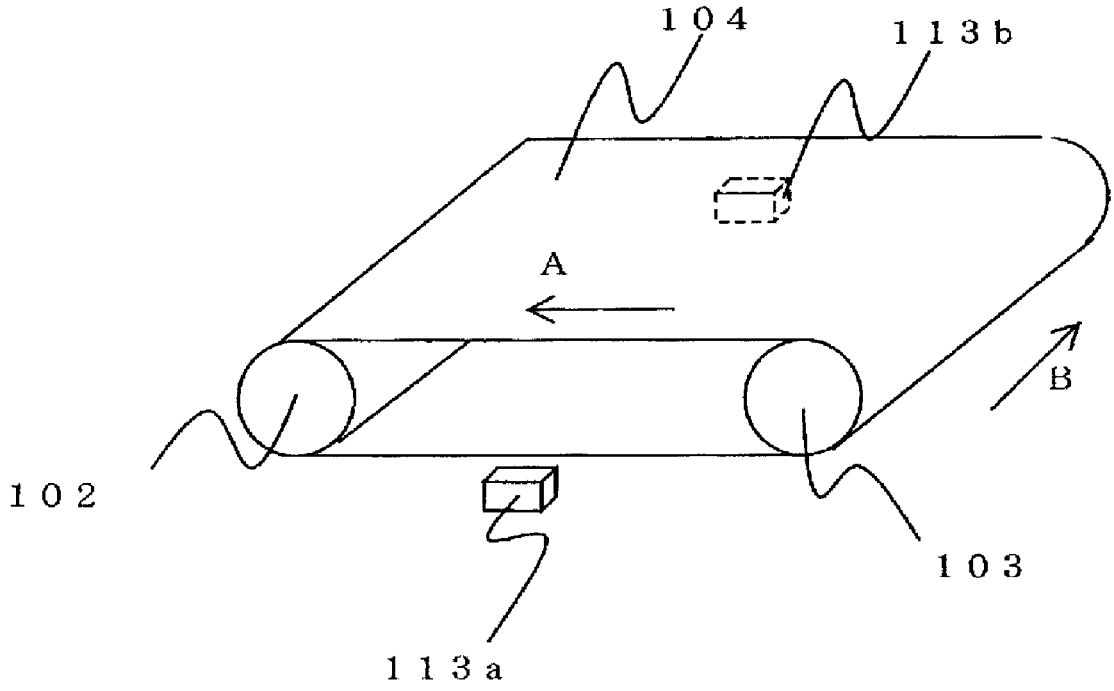
FIG. 20 is a view illustrating a structure in which a belt detection sensor is disposed in the conventional example.
Figure 21:
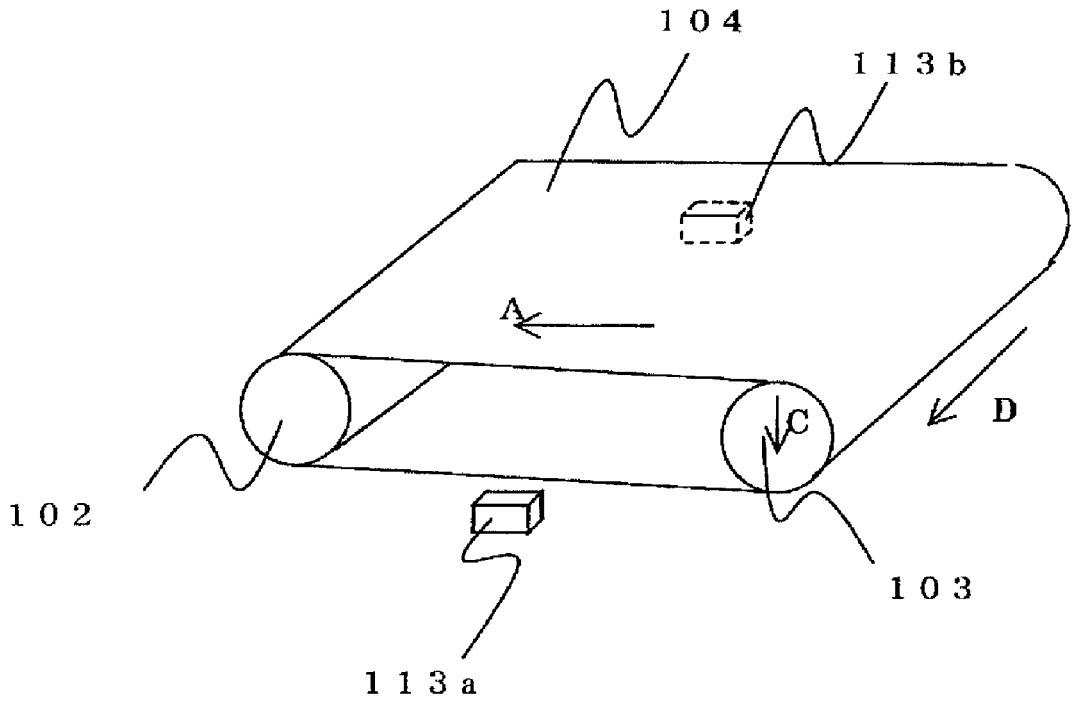
FIG. 21 is a view illustrating a mode in which a roller axial angle is corrected based on a detection signal from a belt detection sensor in the conventional example.
Figure 22:
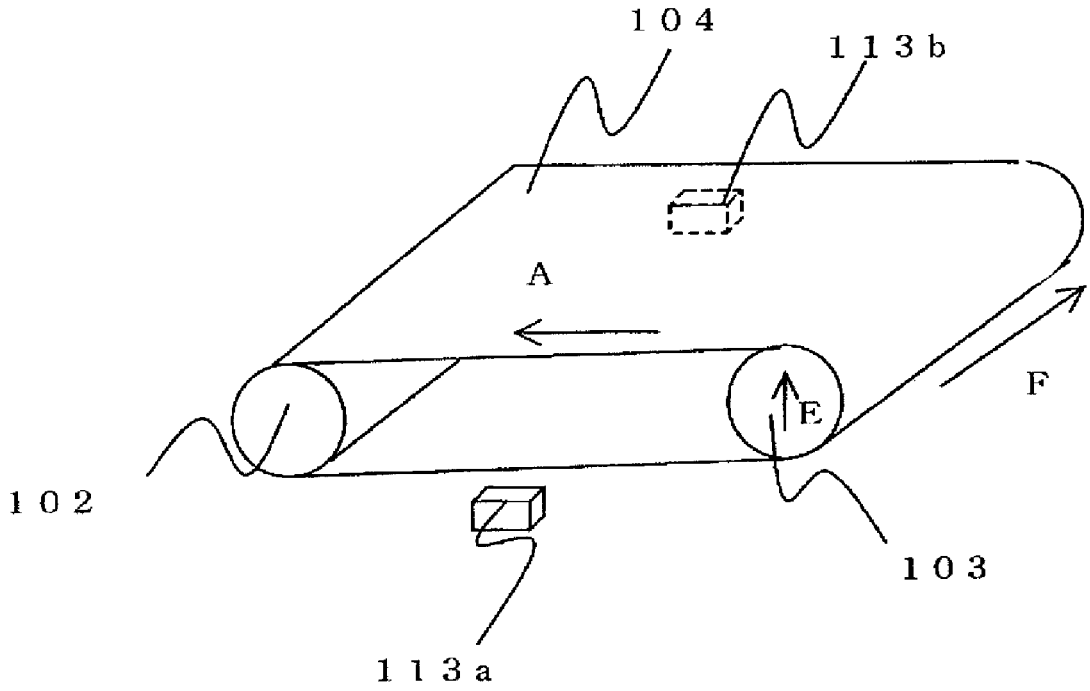
FIG. 22 is a view illustrating a mode in which the roller axial angle is corrected in an opposite direction in the conventional example.

Further, as shown in FIG. 15, string members or wire members composed of shape memory alloy fibers 209 and formed in an annular state may be used as the spring members 209*a*, 209*b* as the thermally responsive members in place of the coil-shaped spring members 209*a*, 209*b*. In this case, since the shape memory alloy fibers are shrunk by heat, the inclination of the driven roller 203 is changed. Further, as shown in FIG. 16, when coiled extendable shape memory alloy fibers 209 are used, they can output a large amount of force. Further, it is also possible to automatically adjust the inclination of the rotational axis line of the driven roller 203 by elastically deforming a sheet-shaped elastic member 209 shown in FIGS. 17 and 18.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-334125, filed Dec. 12, 2006, which is hereby incorporated by reference herein in its entirety.

What is claimed is:

1. An endless belt conveying apparatus comprising:

an endless belt;

a supporting member which rotatably supports the belt;

a driving mechanism which causes the belt to rotate;

a heating member which heats the belt; and a displacing device which displaces one longitudinal end of the supporting member to move the belt in a width direction of the belt;

wherein the displacing device comprises a thermally responsive member which is thermally deformed as the belt heated by the heating member approaches the thermally responsive member in the width direction, so as to control a moving direction of the belt in the width direction.

2. An endless belt conveying apparatus according to claim 1, wherein the thermally responsive member restores the deformation thereof as the belt becomes far from the thermally responsive member.

3. An endless belt conveying apparatus according to claim 1, wherein the thermally responsive member comprises a shape memory alloy.

4. An endless belt conveying apparatus according to claim 2, wherein the thermally responsive member comprises an urging member having such a feature that the urging force acting on the supporting member changes according to a temperature.

5. An endless belt conveying apparatus according claim 1, wherein the displacing device comprises a plurality of the thermally responsive members for displacing longitudinal ends of the supporting member.

6. A toner image heating apparatus comprising:

an endless belt which heats a toner image on a recording material at a nip portion;

a supporting member which rotatably supports the belt;

a driving mechanism which causes the belt to rotate;

a heating member which heats the belt; and a displacing device which displaces one longitudinal end of the supporting member to move the belt in a width direction of the belt;

wherein the displacing device comprises a thermally responsive member which is thermally deformed as the belt heated by the heating member approaches the thermally responsive member in the width direction, so as to control a moving direction of the belt in the width direction.

7. A toner image heating apparatus according to claim 6, wherein the thermally responsive member restores the deformation thereof as the belt becomes far from the thermally responsive member.

8. A toner image heating apparatus according to claim 7, wherein the thermally responsive member comprises a shape memory alloy.

9. A toner image heating apparatus according to claim 7, wherein the thermally responsive member comprises an urging member having such a feature that the urging force acting on the supporting member changes according to a temperature.

10. A toner image heating apparatus according to claim 6, wherein the displacing device comprises a plurality of the thermally responsive members for displacing longitudinal ends of the supporting member.

* * * * *